US005813748A

United States Patent [19]

Maxymych

[11] Patent Number: 5,813,748

[45] Date of Patent: Sep. 29, 1998

[54] ILLUIMINATED TRANSACTION TRAY

[76] Inventor: Peter Nicholas Maxymych, 4700 St. Catherine Street West, Suite 606, Westmount, Montreal, Quebec, Canada, H3Z 1S6

[21] Appl. No.: 823,161

[22] Filed: Mar. 25, 1997

[51] Int. Cl.[6] ..... F21V 33/00

[52] U.S. Cl. ..... 362/154; 362/84; 362/98; 362/234; 362/253; 362/812; 40/324; 40/544; 206/564

[58] Field of Search ..... 362/84, 97–99, 362/154, 155, 234, 253, 812; 40/312, 313, 323, 324, 492, 530, 544, 573, 574; 206/565, 557

[56] References Cited

U.S. PATENT DOCUMENTS

| | | | |
|---|---|---|---|
| D. 310,910 | 10/1990 | Maxymych et al. | D3/249 |
| 1,293,187 | 2/1919 | Peters | 362/134 |
| 2,659,486 | 11/1953 | Krupin | 206/565 |
| 2,806,715 | 9/1957 | Smith | 362/99 |
| 2,891,326 | 6/1959 | Fransson | 362/99 |
| 4,139,138 | 2/1979 | Besselman, Jr. | 362/154 |
| 4,195,431 | 4/1980 | Neufeld | 40/544 |
| 4,679,691 | 7/1987 | Halloran | 206/557 |
| 4,751,620 | 6/1988 | Wright et al. | 362/99 |
| 4,803,604 | 2/1989 | Nichols et al. | 362/154 |
| 5,355,115 | 10/1994 | Goor et al. | 362/154 |
| 5,355,289 | 10/1994 | Krenn | 362/253 |
| 5,440,458 | 8/1995 | Volk | 362/84 |

*Primary Examiner*—Alan Cariaso
*Attorney, Agent, or Firm*—Diller, Ramik & Wight, PC

[57] ABSTRACT

A transaction tray comprises a tray portion and a hinged lid portion. The tray portion has a transaction compartment and a storage compartment, and lighting means associated with the transaction compartment. The lid portion has a flat outer surface and a parallel inner surface. A first transparent window is provided in the outer surface of the lid and a second transparent window in the inner surface. A first translucent advertising substrate is displayed in the first window and a second translucent advertising substrate is displayed in the second window. A lighting means is provided between the first and second translucent substrates whereby the transaction tray will be lit by the lighting means and the translucent advertising substrates will be displayed and backlit from both sides of the hinged lid.

6 Claims, 3 Drawing Sheets

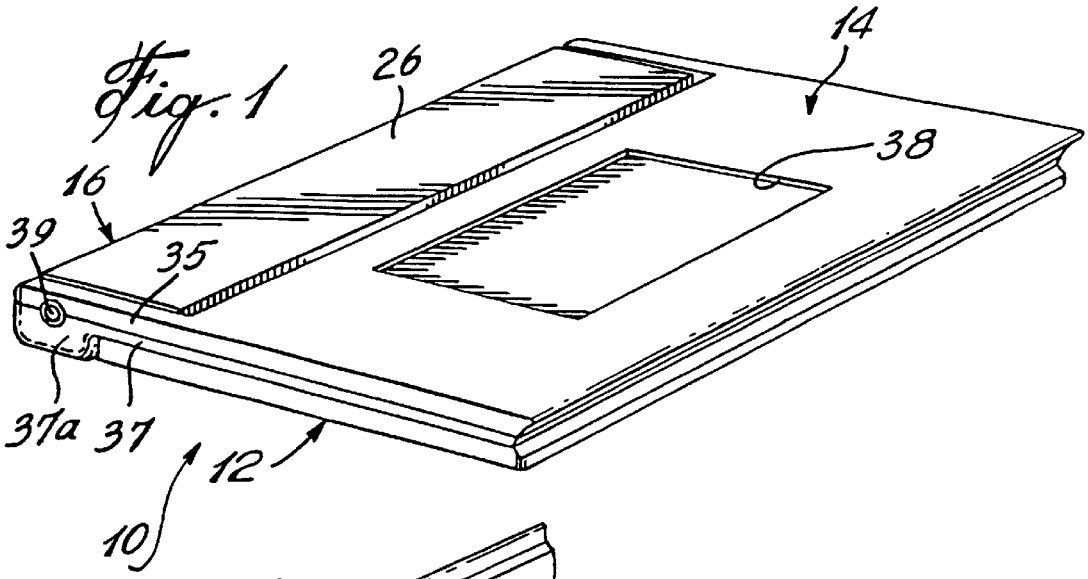
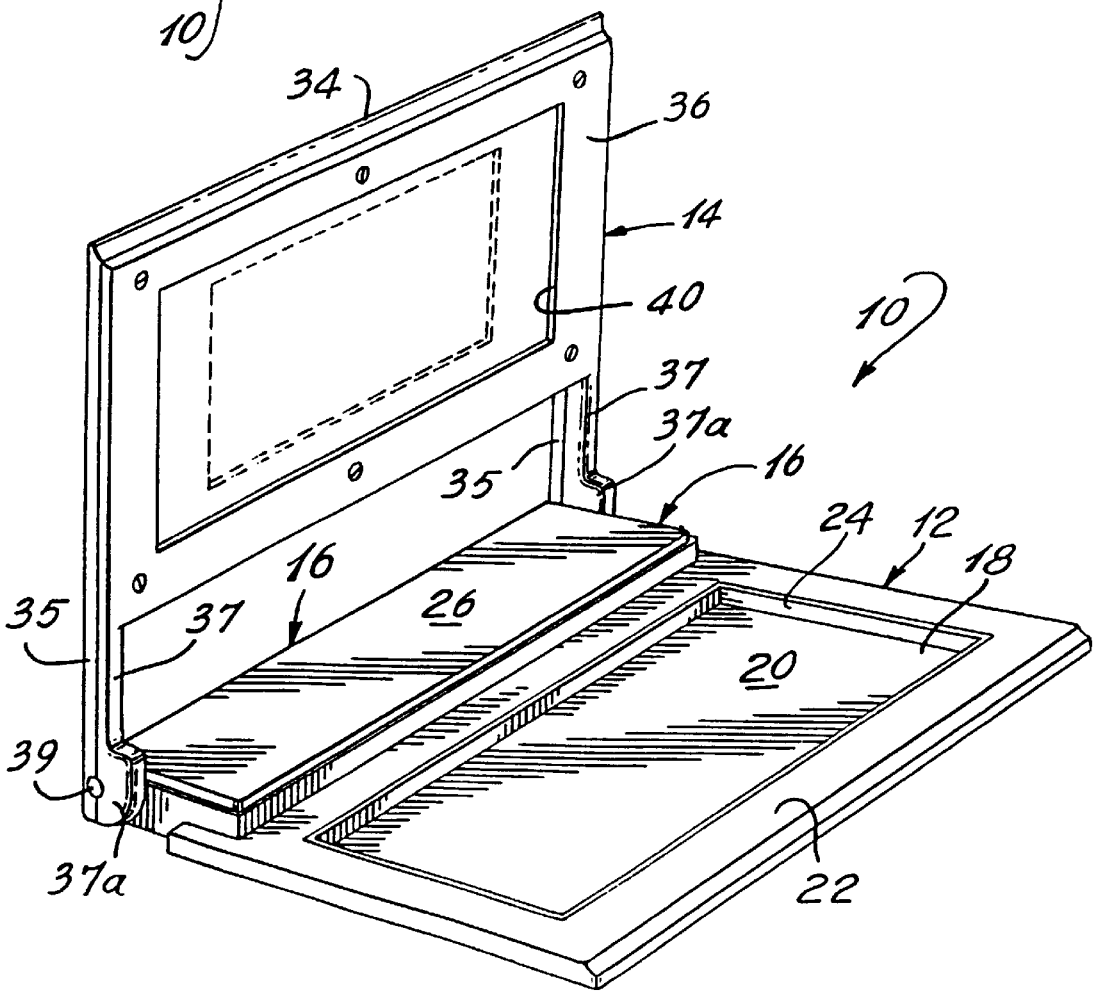
Fig. 2

ILLUIMINATED TRANSACTION TRAY

BACKGROUND OF THE INVENTION

1. Field of the Invention

The present invention relates to an illuminated transaction tray, and more particularly, to a transaction tray that has advertising and other media capabilities in addition to the primary use of the tray, that is, supporting a credit card for review and signature as well as point of sale transactions.

2. Description of the Prior Art

Tip trays are quite common in restaurants and bars. The waiter or waitress usually delivers the check to the customer directly at the table for the customer's review. The customer then leaves cash or a credit card in the tip tray. The server then collects the tip tray, brings it to the cashier to complete the transaction or to process the credit card, and then returns the tip tray to the customer. The customer reviews the transaction sheet, leaves a tip, or signs the credit card transaction slip. The customer has had access to the tray at least twice. Mostly the restaurant or bar is poorly lit, and it sometimes requires supplemental lighting, such as a flashlight carried by the server, to properly read the transaction sheet on the tray.

There is also technology available to allow for electronic point of sale transactions, that is, where a credit or bank card can be processed directly from a tray.

Lighted tip trays are already known from U.S. Pat. No. 4,803,604, Nichols et al, issued Feb. 7, 1989, which describes a serving tray having a peripheral rim with LEDs positioned on the tray for illuminating the tray in a dark environment, such as a night club. U.S. Pat. No. 5,355,289, Krenn, issued Oct. 11, 1994, also describes a serving tray that is lit by LEDs. Both of these patents are simple trays and fairly large, without being concerned about the space required for the circuit and the lights.

U.S. Pat. No. 4,679,691, Halloran, issued Jul. 14, 1987, describes a serving tray with the capability of having advertising windows so that the customer is exposed to such advertising when completing a transaction.

U.S. Design Pat. No. D-310,910, Maxymych et al, shows an illuminated credit card tablet with a lid.

SUMMARY OF THE INVENTION

It is an aim of the present invention to provide an improved transaction tray over U.S. Design Pat. No. D-310, 910.

It is a further aim of the present invention to provide a transaction tray which is compact and which combines advertising windows with backlighting and lighting for reviewing and completing the transaction.

It is a further aim of the present invention to provide a compact transaction tray incorporating batteries for the lighting circuits, and a tray and a cover for the purpose of providing confidentiality for the transaction and for displaying backlit advertising.

A construction in accordance with the present invention comprises a transaction tray having a tray portion and a hinged lid portion, the tray portion having a transaction compartment and a storage compartment, lighting means associated with the transaction compartment, the lid portion having a flat outer surface and a parallel inner surface, a first transparent window in the outer surface of the lid and a second transparent window in the inner surface, a first translucent intelligence bearing substrate displayed in the first window and a second translucent intelligence bearing substrate in the second window, and a lighting means between the first and second translucent substrates, whereby the transaction tray will be lit by the lighting means and the translucent substrates will be displayed and backlit from both sides of the hinged lid.

The advantage of the transaction tray in accordance with the present invention is that a compact tray, having a lid for confidentiality of the transaction, is provided, wherein the tray is properly illuminated for the customer, and intelligence, such as advertising messages, can be illuminated and displayed on both faces of the lid.

It is also contemplated that the tray can be converted to a point of sale transaction instrument without significantly changing the nature of the invention.

DESCRIPTION OF THE PREFERRED EMBODIMENTS

Having thus generally described the nature of the invention, reference will now be made to the accompanying drawings, showing by way of illustration, a preferred embodiment thereof, and in which:

FIG. 1 is a perspective view of an embodiment of a transaction tray in a closed position in accordance with the present invention;

FIG. 2 is a perspective view of the embodiment shown in FIG. 1 but in an open position;

Figure 3:
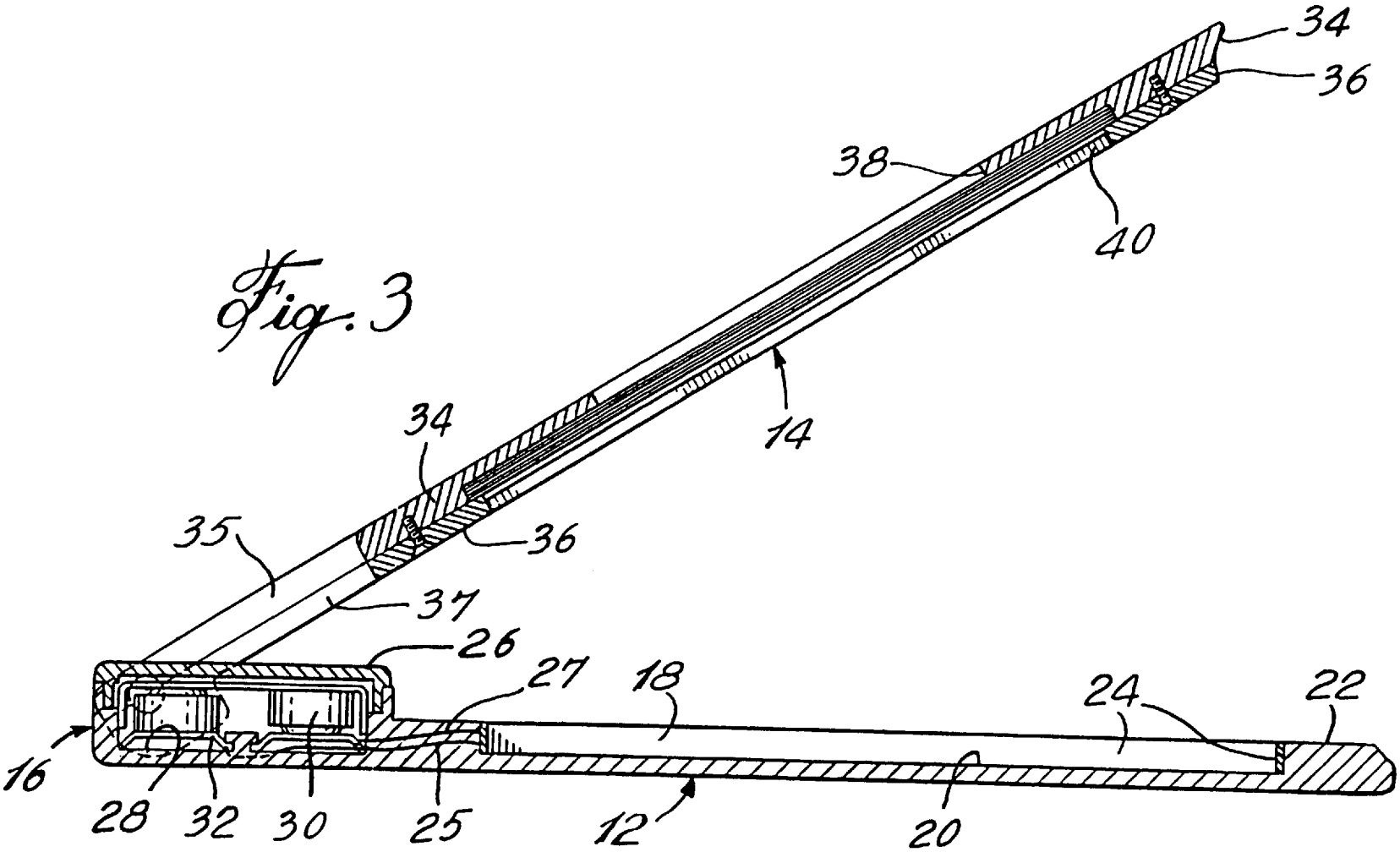
FIG. 3 is a vertical cross-section extending laterally of the transaction tray in an open position.
Figure 4:
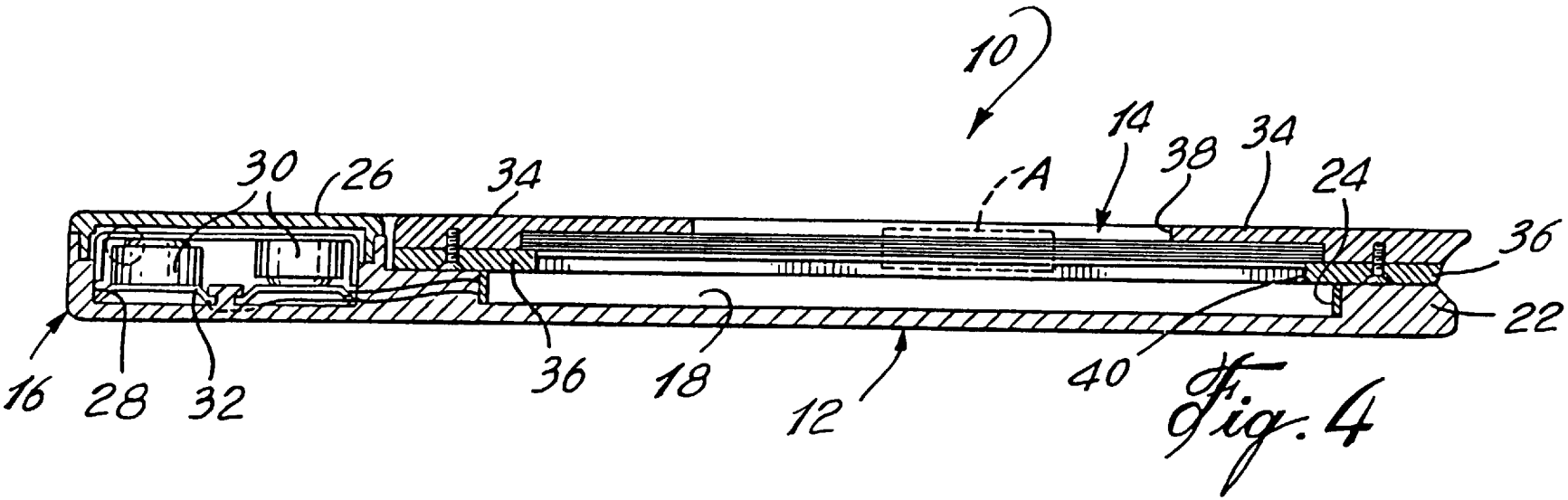
FIG. 4 is a vertical cross-section, similar to FIG. 3, showing the transaction tray in a closed position.

The embodiment shown in these drawings illustrates a transaction tray used by servers in restaurants and bars. The transaction tray 10 includes a tray 12 and a hinged lid 14. The rear of the tray 12 includes a battery and circuit compartment 16.

The tray 12 includes a recessed portion 18 surrounded by a raised periphery 22. The recessed portion includes a bottom surface 20, and an illumination strip 24 surrounds the bottom surface 20, as shown in FIG. 2, for instance.

The illumination strip 24 is an electro luminescent flexible strip that is a laminate including phosphorent substance and is available from Max-Sun Technologies Inc., of Montreal, Quebec, Canada. Positive and negative leads can be connected at any point to the strip 24 and, with sufficient current, the strip will be illuminated in order to illuminate the recessed area 18. The illumination strip 24 is connected by way of leads 25 and 27 to a suitable circuit in the compartment 16. The compartment 16 includes a recess 28 in which batteries 30 are connected to terminals 32. The circuit might include an on/off switch S to shut the current to the illumination strip 24 when the lid 14 is closed onto the tray 12. The recess 28 is closed by a removable lid 26, closing off the compartment 16.

The lid 14 includes a pair of panels 34 and 36 which are fastened together. Panel 34 has a pair of leg extensions 35 while panel 36 has leg extensions 37. The end of leg extensions 37 includes an enlarged portion 37*a* and defines with the leg portion 35 an opening to be journaled on the pivot pin 39. Thus, legs 35, 37, provided at each end of the lid 14, provide for the lid 14 to pivot.

Figure 5:
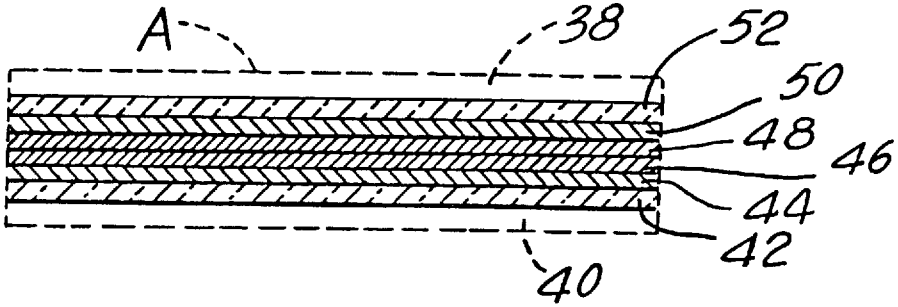
FIG. 5 is an enlarged fragmentary cross-section of the area identified A in FIG. 4.

The panel 34 defines an upper window 38 while the panel 36 defines a lower window 40. Sandwiched between the panels 34 and 36 and exposed to the windows 38 and 40 are a plurality of layers as will be described in reference to FIG. 5. From the bottom window 40 and in ascending order, there is a transparent film 42 and a then translucent intelligence bearing layer 44. An advertising message could be displayed on this translucent layer 44. Independent illumination strips 46 and 48 are next. These illumination strips are cut to a length and width which corresponds to the length and width of the layers 42 through 52. Above the pair of illuminating strips 46 and 48, there is another translucent layer 50 which might represent a different advertising message to be displayed and viewed from the exterior of the tray 10, particularly when the lid is closed onto the tray. Finally, a transparent film 52 completes the window 38 from the top.

Accordingly, illuminated advertising or other message can be seen from the upper window 38 when the transaction tray 10 is closed. When the transaction tray is open, such as in FIG. 2, an advertising message 44 is displayed through window 40 and is lit from behind by means of illumination strip 46. The illumination strip 46 and illumination strip 48 are connected to the operating electrical circuit in a similar manner to illumination strip 24. The leads (not shown) could pass through the hinge arms 35 and 37 to the compartment 16.

The transaction tray 10 has been described as a typical server tray for handling cash or credit cards, that is, in the same manner as a conventional tip tray. However, it is contemplated that a similar transaction tray, in accordance with the present invention, could be provided with point of purchase capabilities using presently known technology, such as a credit card reader and even a printer in place of the recess 18.

I claim:

1. A transaction tray comprising a tray portion and a hinged lid portion, the tray portion having a transaction compartment and a storage compartment, lighting means associated with the transaction compartment, the lid portion having a flat outer surface and a parallel inner surface, a first transparent window in the outer surface of the lid and a second transparent window in the inner surface, a first translucent intelligence bearing substrate displayed in the first window and a second translucent intelligence bearing substrate displayed in the second window, and a lighting means between the first and second translucent substrates whereby the transaction tray will be lit by the lighting means and the translucent substrates will be displayed and backlit from both sides of the hinged lid.

2. A transaction tray as defined in claim 1, wherein the lighting means includes flexible electro luminescent strips.

3. The transaction tray as defined in claim 2, wherein the illumination strips are connected to an electrical circuit within the storage compartment and the current is supplied by battery means within the storage compartment.

4. The transaction tray as defined in claim 3, wherein the storage compartment is at the rear of the tray and the lid is hinged with hinge legs on either side of the storage tray.

5. The transaction tray as defined in claim 2, wherein an illumination strip is provided on the sides of the recessed portion in the tray.

6. The transaction tray as defined in claim 1, wherein a first transparent film is provided in the first transparent window superimposing the first translucent intelligence bearing substrate, and a second transparent film is provided in the second window over the second translucent intelligence bearing substrate.

* * * * *